US005234276A

United States Patent [19]

Semerjian et al.

[11] Patent Number: 5,234,276

[45] Date of Patent: Aug. 10, 1993

[54] TRIGGER ENCLOSURE FOR RING BINDER

[75] Inventors: Joseph K. Semerjian, Des Plaines; Joseph M. O'Neill, Darien, both of Ill.

[73] Assignee: Acco USA, Inc., Wheeling, Ill.

[21] Appl. No.: 876,650

[22] Filed: Apr. 30, 1992

[51] Int. Cl.[5] ..... B42F 13/00

[52] U.S. Cl. ..... 402/38; 16/251; 402/41

[58] Field of Search ..... 402/38, 41, 4, 80 R, 402/80 P; 16/225, 250, 251

[56] References Cited

U.S. PATENT DOCUMENTS

| | | | |
|---|---|---|---|
| 2,105,235 | 1/1938 | Schade | 402/38 |
| 2,789,561 | 4/1957 | Bonn et al. | 402/41 |
| 3,205,896 | 9/1965 | Weichert | 402/38 |
| 3,665,552 | 5/1972 | Toldo et al. | 16/251 |
| 4,700,876 | 10/1987 | Wingert | 227/156 X |

FOREIGN PATENT DOCUMENTS

| | | | |
|---|---|---|---|
| 2211114 | 10/1972 | Fed. Rep. of Germany | 402/38 |
| 1150714 | 7/1959 | France | 402/41 |
| 1262225 | 4/1961 | France | 402/41 |

*Primary Examiner*—Paul A. Bell

*Attorney, Agent, or Firm*—Pennie & Edmonds

[57] ABSTRACT

A trigger lever enclosure for surrounding and enclosing the trigger of a ring binder which enclosure is rigid and larger than the trigger to increase trigger leverage. The enclosure may be removable.

6 Claims, 2 Drawing Sheets

TRIGGER ENCLOSURE FOR RING BINDER

BACKGROUND OF THE INVENTION

It has been proposed to attach extensions to brush handles (U.S. Pat. No. 4,751,762); to lock keys (U.S. Pat. No. 4,562,712); and to fastener slide bars (U.S. Pat. No. 4,143,172) but no enclosures have been proposed for enclosing ring binder triggers.

SUMMARY OF THE INVENTION

Broadly, the invention comprises an enclosure for a ring binder trigger lever for making the trigger lever easier to operate including making the trigger lever longer. The enclosure preferably comprises two plastic pieces which may be hinged or separate which pieces can be snapped together using hand pressure and unsnapped using a screw driver or other similar tool.

It is a feature that the trigger enclosure can be removed and used in oeprating other binders.

DESCRIPTION OF THE PREFERRED EMBODIMENT

Figure 1:
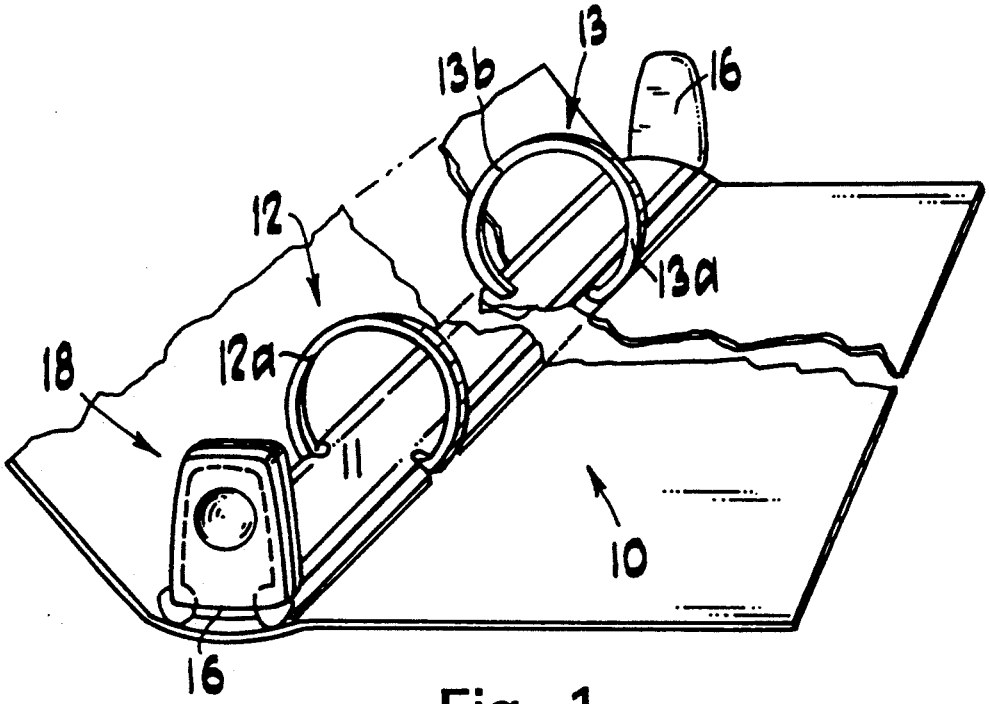
FIG. 1 is a partial perspective view of a ring binder with a trigger enclosure unit positioned thereon.

In the figures, ring binder 10 includes elongated arched casing 11 rings 12, 13 composed of ring halves 12*a*, 12*b* and 13*a*, 13*b* and metal trigger 16s for opening and closing. Enclosed around one trigger lever 16 is trigger enclosure unit 18.

Trigger enclosure unit 18 has a trigger pocket halve 18*a* and a trigger retainer halve 18*b* which halves 18*a*, 18*b* are hinged about hinge 19. The entire unit 18 including hinge 19 is preferably made of plastic material. Other suitable materials may be used.

Figure 3:
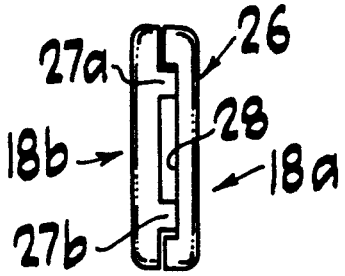
FIG. 3 is a view of the end opposite the hinge of the enclosure unit in its closed position.
Figure 2A:
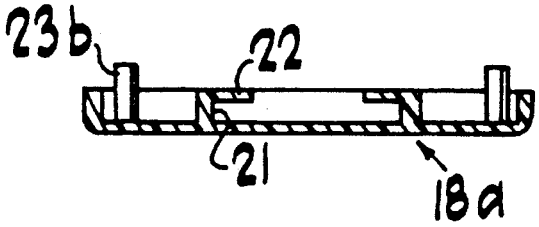
FIG. 2*a* is a sectional view along line 2*a*—2*a* of FIG. 2.
Figure 4:
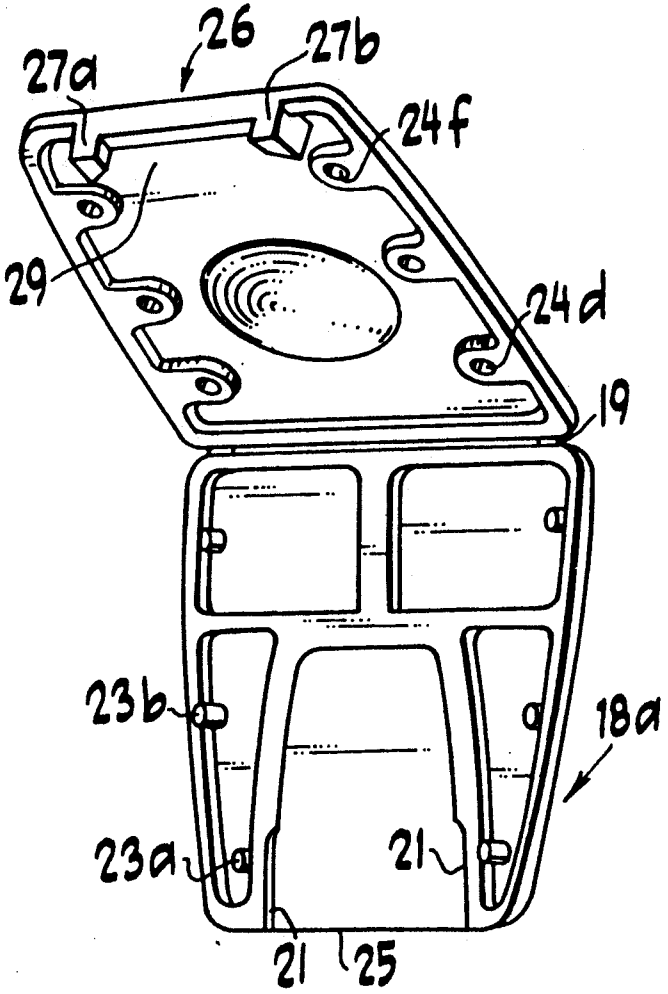
FIG. 4 is a perspective view showing the trigger lever enclosue unit in a half open position.
Figure 2:
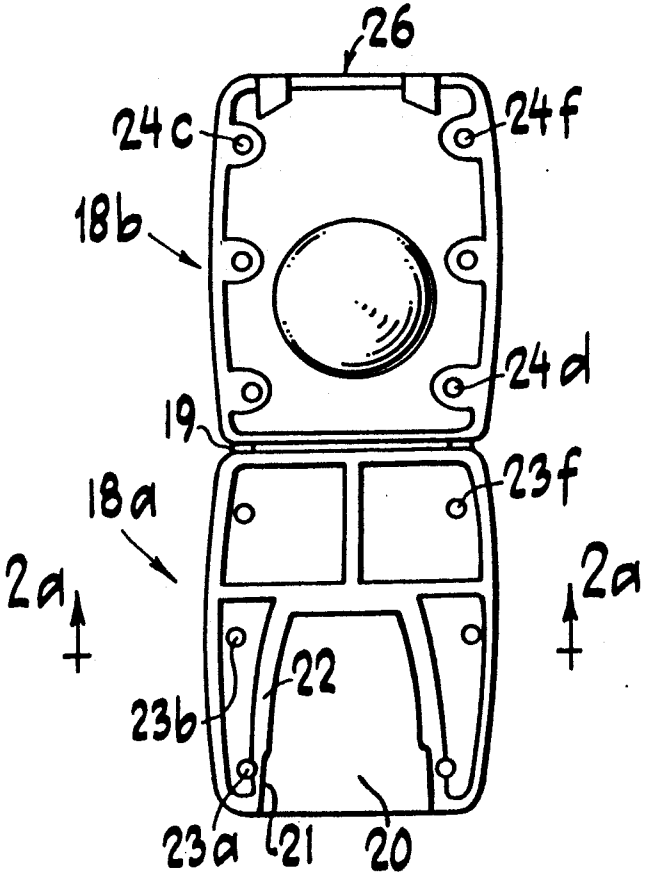
FIG. 2 is a plan view of the enclosure unit in the fully open position.

Trigger pocket half 18*a* includes a trigger lever pocket 20 shaped to receive the generally planar trigger lever 16. Pocket 20 includes generally v-shaped vertical walls 21 and overhanging lips 22. Half 18*a* also includes six (6) studs 23*a-f* which snugly fit into six (6) recesses 24*a-f* in half 18*b*. Half 18*b* also includes a trigger-retainer lip end 26 including projections 27*a, b* forming together with half 18*a*, edge 25, opening 28 to accommodate trigger lever 16 (FIGS. 3 and 1). Lip end 26 prevents the withdrawal of unit 18 from trigger lever 16 once unit 18 is placed around trigger lever 16 and snapped together to engage studs 23*a-f* and recesses 24*a-f* in frictional snap-together locked position.

The purpose of the enclosure unit 18 is to make metal trigger levers 16 easier on the hands of the binder operator and/or to make trigger lever 16 longer so more leverage is available. The enclosure unit 18 is preferably removable without breaking or damaging so it can be reused, but enclosures that cannot be removed without destruction are also contemplated by this invention.

We claim:

1. In combination, a ring binder having a configured trigger lever and an enclosure means positioned adjacent said lever configured for enclosing said lever.

2. The combination of claim 1 in which the enclosure is rigid and is larger than said trigger lever to make the trigger lever effectively longer.

3. The combination of claim 1 in which said enclosure means is shaped to be placed in a position around the trigger lever and thereafter removed.

4. The combination of claim 1 in which the enclosure means comprises:

a) a first half;

b) a second half and c) fastener means for fastening the two halves together.

5. The combination of claim 4 in which said fastener means permits the releasing of said halves without damaging the enclosure means.

6. The combination of claim 4 wherein said fastener means further comprises snap fastener means provided for engaging the two halves by application of hand pressure.

* * * * *

UNITED STATES PATENT AND TRADEMARK OFFICE

CERTIFICATE OF CORRECTION

PATENT NO. : 5,234,276

DATED : August 10, 1993

INVENTOR(S) : Joseph K. Semerjian and M. O'Neill

It is certified that error appears in the above-indentified patent and that said Letters Patent is hereby corrected as shown below:

Column 2, line 32, "trigger lever and thereafter removed" should read --trigger lever and thereafter removed without breaking or destroying--.

Signed and Sealed this

Fifteenth Day of March, 1994

*Attest:*

*Attesting Officer*

Bruce Lehman

BRUCE LEHMAN

*Commissioner of Patents and Trademarks*